US007021574B2

(12) United States Patent
Berger et al.

(10) Patent No.: US 7,021,574 B2
(45) Date of Patent: Apr. 4, 2006

(54) OVERMOLDED VIBRATION ISOLATION GASKET FOR MOUNTING FOOD WASTE DISPOSER TO SINK

(75) Inventors: Thomas R. Berger, Racine, WI (US); Cynthia C. Jara-Almonte, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 93 days.

(21) Appl. No.: 10/404,581

(22) Filed: Apr. 1, 2003

(65) Prior Publication Data

US 2004/0195409 A1 Oct. 7, 2004

(51) Int. Cl.
*B02C 18/42* (2006.01)

(52) U.S. Cl. ..... 241/46.016; 241/46.014; 241/46.015

(58) Field of Classification Search ..... 241/46.014, 241/46.015, 46.016
See application file for complete search history.

(56) References Cited

U.S. PATENT DOCUMENTS

| | | | | |
|---|---|---|---|---|
| 2,743,875 A | | 5/1956 | Brezosky | 241/100.5 |
| 2,819,915 A | * | 1/1958 | Woodson | 241/46.015 |
| 2,894,698 A | | 7/1959 | Brucken | 241/257 |
| 2,945,635 A | * | 7/1960 | Jordan | 241/46.015 |
| 2,951,650 A | | 9/1960 | Gould | 241/286 |
| 2,965,317 A | * | 12/1960 | Jacobs | 241/46.013 |
| 2,975,986 A | | 3/1961 | Frank | 241/100.5 |
| 3,025,007 A | | 3/1962 | Weiczorek | 241/100.5 |
| 3,684,199 A | * | 8/1972 | Bebinger | 241/46.015 |
| 3,801,998 A | * | 4/1974 | Macias | 4/629 |
| 3,862,720 A | * | 1/1975 | Guth | 241/46.015 |
| 5,924,635 A | | 7/1999 | Koshimizu | 241/46.015 |
| 6,427,504 B1 | * | 8/2002 | Janssen et al. | 70/278.3 |
| 6,481,652 B1 | | 11/2002 | Strutz | 241/46.013 |

* cited by examiner

*Primary Examiner*—Derris H. Banks
*Assistant Examiner*—Jason Y Pahng
(74) *Attorney, Agent, or Firm*—Locke Liddell & Sapp LLP

(57) ABSTRACT

Disclosed herein is a vibration isolation gasket for mounting a food waste disposer to a sink that is at least partially molded onto a portion of the housing of the disposer, and preferably to the disposer's container cover. The vibration isolation gasket preferably includes a rubberized and integrally-formed gasket portion, sleeve portion, and over-molded portion. The gasket portion couples to the drain opening and may contain pleats to prevent food ejection from the disposer. The sleeve portion connects the gasket and over-molded portions, bears the weight of the disposer as it hangs from the sink, and acts as the primary structure for reducing vibration-induced noise. The over-molded portion is preferably molded onto the top and bottom of the container cover, which is in turns crimped to the remainder of the disposer housing.

13 Claims, 5 Drawing Sheets

OVERMOLDED VIBRATION ISOLATION GASKET FOR MOUNTING FOOD WASTE DISPOSER TO SINK

FIELD OF THE INVENTION

The present invention relates generally to a food waste disposer, and more particularly to an over-molded vibration isolation gasket for mounting a food waste disposer to a sink.

BACKGROUND OF THE INVENTION

Conventional food waste disposers are typically coupled to a sink by a mounting gasket, which is typically composed of rubber. The mounting gasket serves as the primary seal between the sink and the disposer and preferably also prevents the transmission of vibration from the disposer to the sink.

In a prior art approach, and referring to FIG. 1, a conventional connecting assembly 40 and rubber mounting gasket 80 are used to attach the disposer to the sink 30. The conventional connecting assembly 40 of FIG. 1 is substantially similar to that described in U.S. Pat. No. 3,025,007, which is incorporated herein by reference. The connecting assembly 40 includes a sink collar 34, a seal plate 50, a mounting flange 60, and a support flange 70.

During assembly, the sink collar 34, seal plate 50, and mounting flange 60 are first secured in place around and underneath the sink 30. More specifically, the sink collar 34 is positioned within the drain opening 32 of the sink 30, leaving drain flange 36 to rest around the drain opening 32 as shown. During assembly, a gasket 54 and the seal plate 50 are slipped onto the sink collar 34 now appearing on the underside of the sink 30. The mounting flange 60 is then slipped onto the collar 34, and a snap ring 62 is seated within an annular recess on the collar 34. Studs 66 are then screwed through threaded holes 64 in the mounting flange 60 until they contact the underside of a projecting surface of the seal plate 50, thus pressing the gasket 54 between the seal plate 50 and the sink 30. (Three studs 66 are normally used, but only one is shown in the cross section of FIG. 1). The mounting flange 60 has inclining flanges 68 onto which the remainder of the disposer (and associated hardware) can be screwed to fix the disposer into position underneath the sink, as will be explained in further detail later.

The food waste disposer includes a container body 10 and a top container cover 20, both preferably formed of metal. The container body 10 has an outwardly extending lip 12 to which edge 22 of the container cover 20 is crimped to seal the top of the disposer. The container cover 20 includes a housing collar 24 that forms the inlet of the disposer. During assembly, the support flange 70 is positioned on the housing collar 24 of the housing, and the mounting gasket 80 is press fit onto an outwardly extending lip 26 of the extruded collar 24 to hold the support flange 70 in place. As shown, the support flange 70 contains inwardly bent tabs 78.

When the disposer (with the support flange 70 in place) is to be affixed to the mounting flange 60 (already supported under the sink), the tabs 78 are positioned to meet with the inclining flanges 68 on the mounting flange 60. Because the inclining flanges 68 are inclined, the tabs 78 (i.e., support flange 70) can be twisted with respect thereto, in effect, screw the disposer onto the mounting flange 60 to position the disposer in place underneath the sink 30. To facilitate turning the support flange 70, the support flange 70 is preferably formed with finger pads 76. (Again, the support flange 70 normally contains three sets of tabs 78 and finger pads 76, but only one such set is shown in the cross-section of FIG. 1). As the support flange 70 is twisted into place, it is brought closer to the mounting flange 60 due to the incline of inclined flanges 68, thereby compressing the mounting gasket 80 therebetween, and further compressing the mounting gasket 80 against an inwardly projecting flange 38 of the collar 34. In short, the flanges 60 and 70 compress the mounting gasket 80 to create a seal between the sink collar 34 and the housing collar 24 on the disposer. The mounting gasket 80 includes a plurality of pleats 87 formed across the drain opening to keep food waste from being ejected through the drain when the disposer is operating.

Food waste disposers produce noise during operation that is caused by the operation of the motor and by the impacting of food waste against the housing of the disposer. These sources produce vibrations having a broad frequency spectrum. The vibration of the disposer can be transmitted into the sink through the connection of the disposer with the sink, which produces objectionable noise in and around the sink. Such noise is particularly evident, for example, in installations with relatively thin stainless steel sinks that act as excellent resonators.

Unfortunately, the conventional connecting assembly 40 and mounting gasket 80 of FIG. 1 create a substantially rigid connection between the food waste disposer and the sink. In particular, vibration is hypothesized to travel through the solid metallic housing collar 24, the compressed mounting gasket 80, and the connecting assembly 40 to the sink 30. Although vibration through the collar 24 is somewhat attenuated by the rubber material of the mounting gasket 80 that surrounds it, further dampening measures would be desirable, particularly if such measures did not significantly impact the structural integrity of the disposer or the manner in which it is affixed under the sink.

The reader is referred to the following U.S. patents for further background concerning ways of minimizing operation noise of food waste disposers, all of which are incorporated herein by reference in their entireties: U.S. Pat. Nos. 2,743,875; 2,894,698; 2,945,635; 2,951,650; 2,965,317; 2,975,986; 3,801,998; 3,862,720; and 5,924,635.

SUMMARY OF THE INVENTION

A vibration isolation gasket for mounting a food waste disposer to a sink is at least partially molded onto a portion of the housing of the disposer, and preferably to the disposer's container cover. The vibration isolation gasket preferably includes a rubberized and integrally-formed gasket portion, sleeve portion, and over-molded portion. The gasket portion couples to the drain opening and may contain pleats to prevent food ejection from the disposer. The sleeve portion connects the gasket and over-molded portions, bears the weight of the disposer as it hangs from the sink, and acts as the primary structure for reducing vibration-induced noise. The over-molded portion is preferably molded onto the top and bottom of the container cover, which is in turn crimped to the remainder of the disposer housing.

The foregoing summary is not intended to summarize each potential embodiment or every aspect of the present disclosure.

BRIEF DESCRIPTION OF THE DRAWINGS

The foregoing summary, a preferred embodiment, and other aspects of subject matter of the present disclosure will be best understood with reference to a detailed description of specific embodiments, which follows, when read in conjunction with the accompanying drawings, in which.

Figure 1:
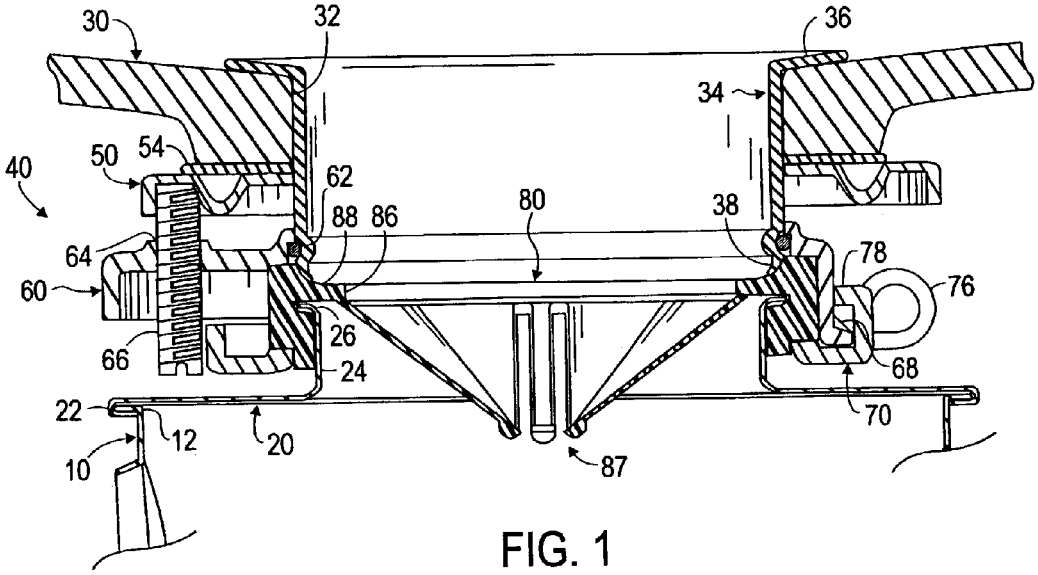
FIG. 1 (Prior Art)
FIG. 1 illustrates a cross-sectional view of a conventional connecting assembly and mounting gasket according to the prior art.

While the disclosed vibration isolation gasket is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person of ordinary skill in the art by reference to particular embodiments, as required by 35 U.S.C. § 112.

DETAILED DESCRIPTION OF PREFERRED EMBODIMENTS

In the interest of clarity, it is understood that not all of the features for an actual implementation of a vibration isolation gasket for mounting a food waste disposer to a sink are described in the disclosure that follows. It will be appreciated, of course, that in the development of any such actual implementation, as in any such project, numerous engineering and design decisions must be made to achieve the developers' specific goals, e.g., compliance with mechanical and business related constraints, which will vary from one implementation to another. While attention must necessarily be paid to proper engineering and design practices for the environment in question, it should be appreciated that the development of a vibration isolation gasket for mounting a food waste disposer to a sink would nevertheless be a routine undertaking for those of skill in the art given the details provided by this disclosure.

Figure 2:
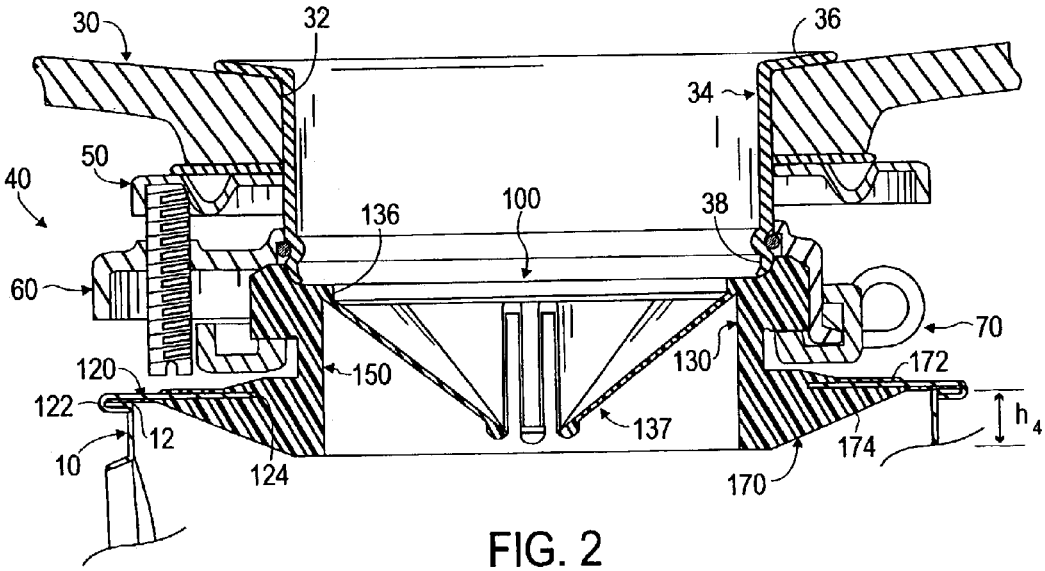
FIG. 2 illustrates a cross-sectional view of an embodiment of a vibration isolation gasket for mounting a disposer to a sink.

Referring to FIG. 2, an embodiment of a vibration isolation gasket 100 for mounting a food waste disposer (not shown) to a sink 30 is illustrated in a cross-sectional view. In contradistinction to the prior art discussed earlier, the disclosed vibration isolation gasket 100 is molded onto a portion of the disposer's housing, and preferably is molded onto a top container cover 120 of the housing. More specifically, gasket 100 contains three main rubberized portions in addition to the metallic container cover 120 that constitute the bulk of the gasket, viz., gasket portion 130, sleeve portion 150, and over-molded-portion 170. Over-molded portion 170 is so named because that portion is molded over the metallic container cover 120. More specifically, over-molded portion 170 preferably constitutes an upper over-mold 172 and a lower over-mold 174.

The rubberized portions 130, 150, and 170 are preferably integrally formed over the container cover 120, which can be accomplished by placing the container cover 120 inside a mold into which molten rubber is poured (or injected) and cured. The rubber material used for these portions preferably constitutes a flexible material, such as Nitrile rubber or ethylene propylene diene terpolymer (EPDM) rubber. The cover 120 is preferably formed of stainless steel, which is approximately 0.02 to 0.04-inch thick.

As noted, it is preferable to form the molded portions 130, 150, and 170 onto the container cover 120, and then to affix the container cover 120 to the remainder of the disposer body. In this regard, the container cover 120 has an edge 122 that is crimped onto a lip 12 of an upper container body 10 of the disposer's housing. The edge 122 is approximately ⅛-inch long prior to its crimping to the lip 12. A seal (not shown) is used between the attachment of the container cover 120 and the lip 12. In an alternative arrangement, the top container cover 120 and upper container body 10 can be integrally formed, but such an integral arrangement is not preferred due to potential problems associated with molding the disclosed vibration isolation gasket 100 to such a large housing component. In particular, the upper container body 10 can act as a significant heat sink, which substantially increases the processing time. Consequently, it is preferred that the vibration isolation gasket 100 be molded onto a separate housing component, such as the top container cover 120 in the present embodiment.

Once formed onto the container cover 120, the support flange 70 is pressed over the deformable gasket portion 130 to facilitate connection of the disposer to the sink 30 as disclosed earlier in the Background section of this disclosure. As the details of the conventional connecting assembly 40 are substantially similar to those described in the Background section of the present disclosure, the structure and function of its components are not repeated here.

The disclosed vibration isolation gasket 100 and top container cover 120 are illustrated in respective side, perspective, top, and bottom isolated views in FIGS. 3A–D. (For illustrative purposes, the edge 122 of the container cover 120 is shown not crimped in FIGS. 3A–4B, as it would be before attaching to the container body of the disposer.) The gasket portion 130 mounts to the sink 30 with the connecting assembly 40 as just discussed. The sleeve portion 150 supports the weight of the disposer once it is positioned under the sink. The over-molded portion 170 as noted connects to the housing of the disposer, e.g., container cover 120. All of these portions 130, 150, and 170 work to reduce the transfer of vibration from the disposer to the sink. In addition, and as in the prior art, a plurality of pleats 137 are preferably formed within a central opening 136 of the gasket portion 130 to keep food waste from being ejected through the opening 136 when the disposer is operating. However, the use of pleats 137 in connection with the gasket portion 130 is not strictly necessary.

Figure 3A:
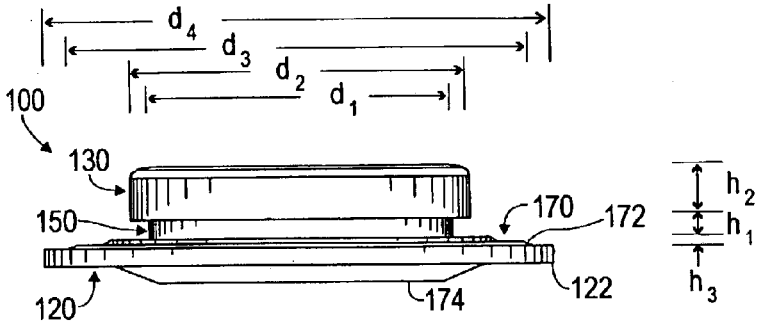
FIGS. 3A–3D respectively illustrate side, perspective, top, and bottom views of the disclosed vibration isolation gasket of FIG. 2.
Figure 3B:
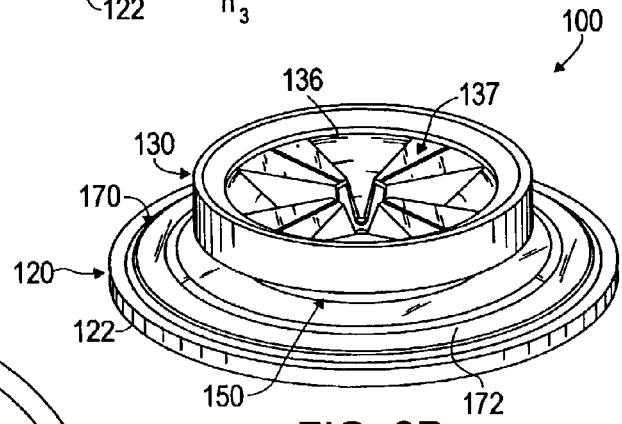
Figure 3C:
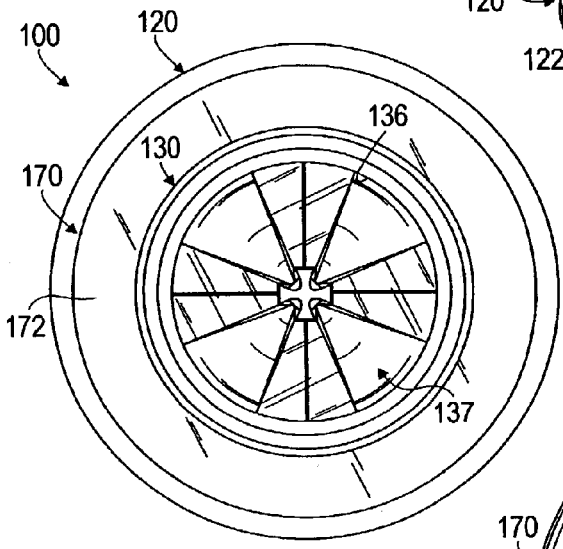

As best shown in FIG. 3A, the sleeve portion 150 preferably has a smaller radial dimension than that of the gasket portion 130 such that it forms a recess in the disclosed gasket 100. In addition, the sleeve portion 150 preferably has a smaller axial dimension than that of the gasket portion 130. In one example of the disclosed gasket 100, the sleeve portion 150 preferably has an outside diameter $d_1$ of approximately 3¼-inches and a height $h_1$ of approximately ¼-inch, while the gasket portion 130 preferably has an outside diameter $d_2$ of approximately 4-inches and a height $h_2$ of approximately ½-inch. Preferably, the sleeve portion 150 has a wall thickness of about ⅛ to ¼-inch and more preferably 0.180-inch, but in any event should be thick enough to support the weight of the disposer (as much as 20 pounds). The disclosed molded gasket 100 is estimated to withstand pullout forces of about 100-lbs. or more.

Figure 4A:
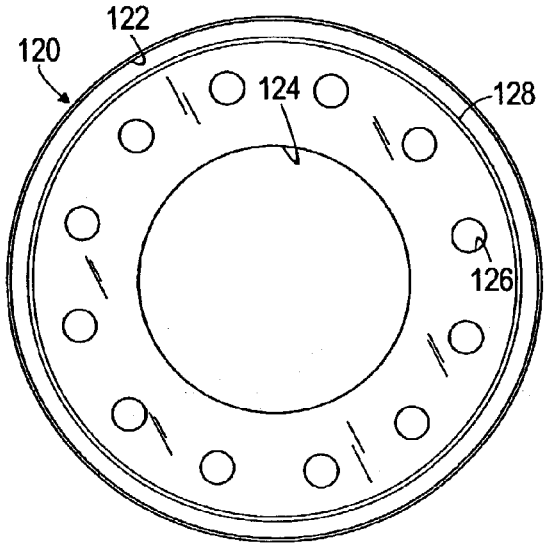
FIGS. 4A–4B illustrate bottom views of embodiments of top container covers for the disclosed vibration isolation gasket of FIG. 2.
Figure 4B:
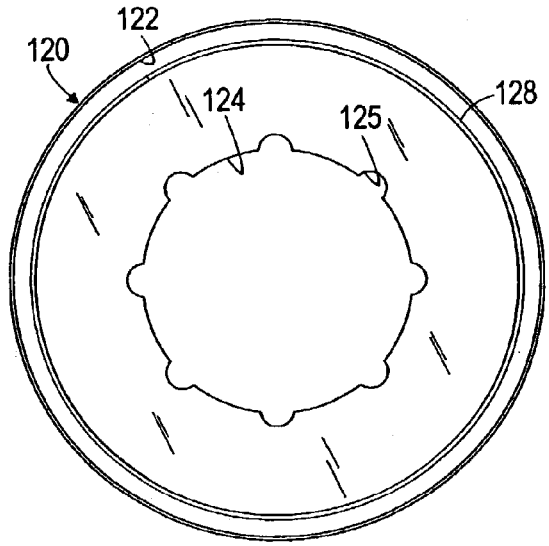

As noted, rubberized portions 130, 150, and 170 are preferably molded to the container cover 120, and several methods can be used to facilitate a good mechanical connection between them and the (usually) metallic cover 120. In this regard, FIGS. 4A–4B illustrate the underside of the container cover 120 before the formation of rubberized components. In FIG. 4A, holes 126 or like structures are formed through the cover 120, which allows the upper and lower over-molds 172 and 174 (not shown in FIGS. 4A–4B) to touch therethrough, improving the connection between the molded components and the cover 120. The size, number, and placement of the holes 126 can vary, so long as the structural integrity of the disposer is not compromised. Preferably, twelve holes 126 having a diameter of about ¼-inch are formed about the central opening 124. The holes 126 are arranged so that the outer edges of the holes 126 lie within a diameter of about 5¼-inches of the cover 120, which represents the preferred outer diameter $d_3$ of the upper over-mold 172 discussed above. Alternatively, as shown in FIG. 4B, the central opening 124 in the cover 120 (normally circular as in FIG. 4A) can have an irregular shape with a plurality of notches 125 formed therein, which can strengthen the attachment of the extruded material of the disclosed gasket 100 to the container cover 120. Preferably, eight, radial notches 125 each having a radius of about 0.150-inch are formed about every 45-degrees around the central opening 124. In addition to having notches or another irregular shape, the opening 124 can have curled edges or like structures (not shown) to remove potentially sharp edges that could cut into the molded material, or could be formed with irregularity on its surfaces (e.g., nooks or tabs) to improve adhesion. Moreover, the container cover 120 can have ribs formed thereon or can have an extruded edge around the opening 124 to improve adhesion. Additionally, the surface of the cover 120 can be roughened, for example, by acid etching, prior to the overmolding process. Other processes and structures well known in the art of overmolding can be used as well, as one skilled in the art will appreciate.

For the best adhesion, it is preferred that overmolded portion 170 has both an upper and lower over-mold 172, 174, but in a given design either of these over-molds could be deleted. Were only one over-mold to be used, the use of lower over-mold 174 is preferred because the weight of the disposer would not tend to peel the container cover 120 away from the mold.

Figure 3D:
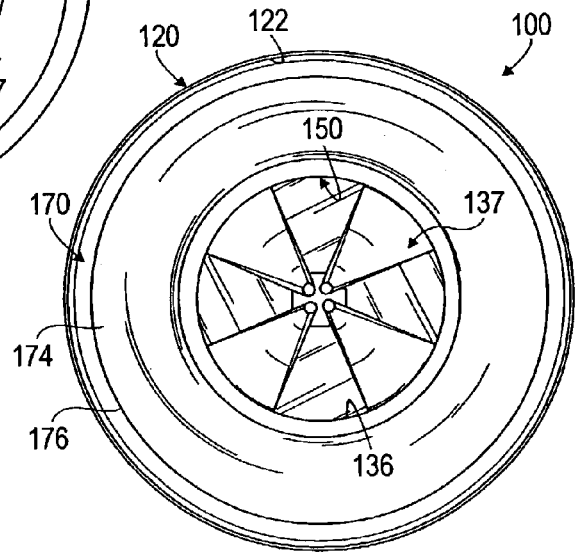
Figure 5:
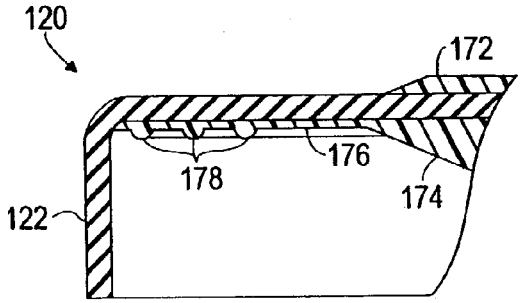
FIG. 5 illustrates a cross-sectional view of a portion of the top container cover and over-molded portion for the disclosed vibration isolation gasket of FIG. 2.

The container covers 120 of FIGS. 4A–B are shown with an annular rim 128 formed close to the periphery of the container cover 120. The rim 128 is formed where the cover 120 engages the lip (12 in FIG. 2) of the container body and assists in sealing the cover 120 thereto. In another modification, and as best shown in FIG. 3D, the lower over-mold 174 of the molded portion 170 can have an optional seal 176 integrally formed about its periphery. The peripheral seal 176 can also be used to seal the attachment of the container cover 120 and lip 12 (FIG. 2) of the container body. A preferred arrangement of the optional seal 176 is shown in the cross-section of FIG. 5. The optional seal 176 preferably extends from the tapering lower-over mold 174 to the edge 122 of the container cover 120 and preferably has a thickness of approximately 0.01-inch. In addition, the optional seal 176 preferably has three annular rims 178 formed thereon for engaging the lip 12 (FIG. 2).

As best shown in FIG. 3A, the upper over-mold 172 preferably has an outer radial dimension greater than that of the gasket portion 130 and almost as great as the top container cover 120. In one example, the upper over-mold 172 can have an outside diameter $d_3$ of approximately 5¼-inches for a container cover 120 having an outside diameter $d_4$ of approximately 6-inches. The upper over-mold 172 has a preferable maximum height $h_3$ of approximately ⅛-inch. The lower over-mold 174 (FIG. 3D) has a similar outside diameter.

The lower over-mold 174 can absorb impact noises created by food in the grinding chamber as well as diminish vibration. As best shown in FIG. 2, the lower over-mold 174 preferably has a height, e.g., height $h_4$ approximately ¼-inch, which preferably is greater than the height of the upper over-mold 172. Furthermore, the lower over-mold 174 preferably tapers from its central region on the gasket 100 towards its outside diameter. Similarly, the upper over-mold 172 also preferably tapers from its central region on the gasket 100 towards its outside diameter.

The disclosed vibration isolation gasket 100 provides a flexible coupling between the disposer and the sink 30 that can reduce the transmission of the vibration to the sink, and accordingly reduce the noise at the sink and surrounding areas. Vibration isolation occurs primarily at the sleeve portion 150. When installed, the sleeve portion 150 is in tension due to the weight of the disposer, which can be as high as 20 pounds, but this amount of tension is relatively low given the composition and dimensions for the sleeve portion 150. Consequently, the sleeve portion 150 is still flexible under the tensile load and is able to absorb the vibration of the disposer caused by the motor and the impacting of food waste. Moreover, and in contradistinction to the prior art illustrated in FIG. 1, no hard metallic components akin to the housing collar 24 are present within or coupled to the gasket 100 to undesirably couple vibrations from the cover 120 to the support flange 70 and/or other structural components coupled to the sink. In addition, the over-molded portion 170 of disclosed gasket 100 also dampens vibration of the housing top, adding additional novelty when compared with the prior art illustrated in FIG. 1.

Vibration in a disposer typically has a broad spectrum, and therefore the disclosed gasket 100 is preferably effective in isolating disposer vibrations over a wide frequency range. The disclosed gasket 100 has been shown through testing to be effective in reducing vibratory noise in a frequency range from 80 to 1000 Hz. These test results are shown in FIGS. 5A–B, and compare vibration and acoustic spectrums of a disposer having a conventional mounting gasket with a disposer having the vibration isolation gasket of the present disclosure.

Figure 6A:
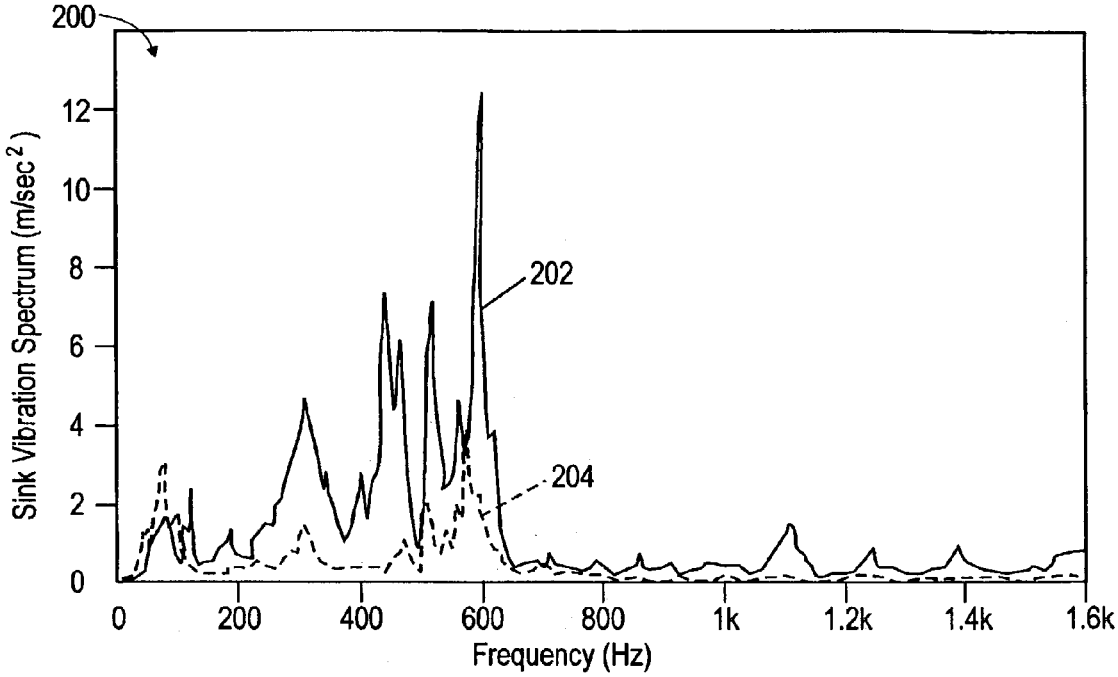
FIGS. 6A–6B respectively illustrate graphs of sink vibration spectrums and acoustic spectrums comparing a disposer having a conventional mounting gasket with a disposer having the disclosed vibration isolation gasket.

Referring to FIG. 6A, sink vibration spectrum 202 is plotted for a 1-hp disposer rigidly mounted to a sink in the conventional manner, while sink vibration spectrum 204 is plotted for a 1-hp disposer mounted to the sink with the disclosed vibration isolation gasket of the present disclosure. The rigidly mounted disposer in spectrum 202 has a spectrum total of approximately 45.5-m/sec$^2$, while the disposer mounted with the disclosed gasket of the present disclosure in spectrum 204 has a spectrum total of approximately 15.3-m/sec$^2$. Consequently, the disclosed gasket reduces the transfer of the disposer's vibration to the sink by as much as a third. As evidenced in the spectrum 204, the disclosed gasket 100 is particularly effective in reducing the transmission of vibration in the frequency range of about 200 to 650 Hz.

Figure 6B:
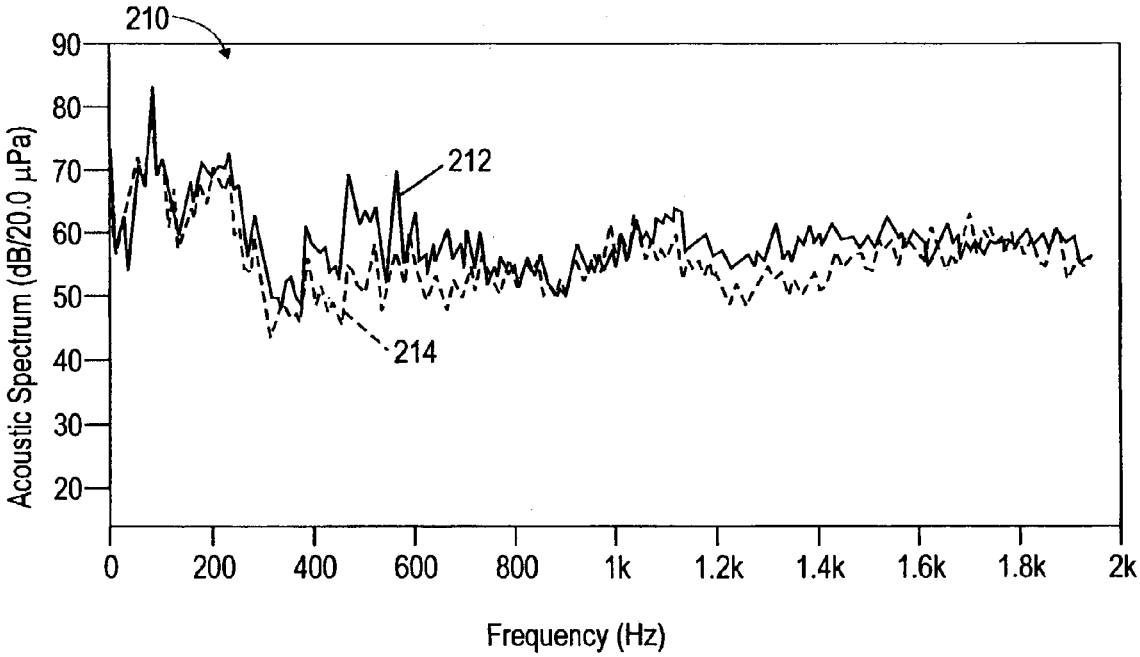

In FIG. 6B, acoustic spectrums 212 and 214 illustrate the relative level of structural noise produced when the two mounting gaskets are used. A first acoustic spectrum 212 is plotted for the 1-hp disposer rigidly mounted to the sink in the conventional manner, and a second acoustic spectrum 214 is plotted for the 1-hp disposer mounted to the sink with the disclosed vibration isolation gasket of the present disclosure. As a result of the improved vibration isolation, the disclosed gasket produced less noise (spectrum 214) when compared to the conventional gasket arrangement (spectrum 212).

Figure 7:
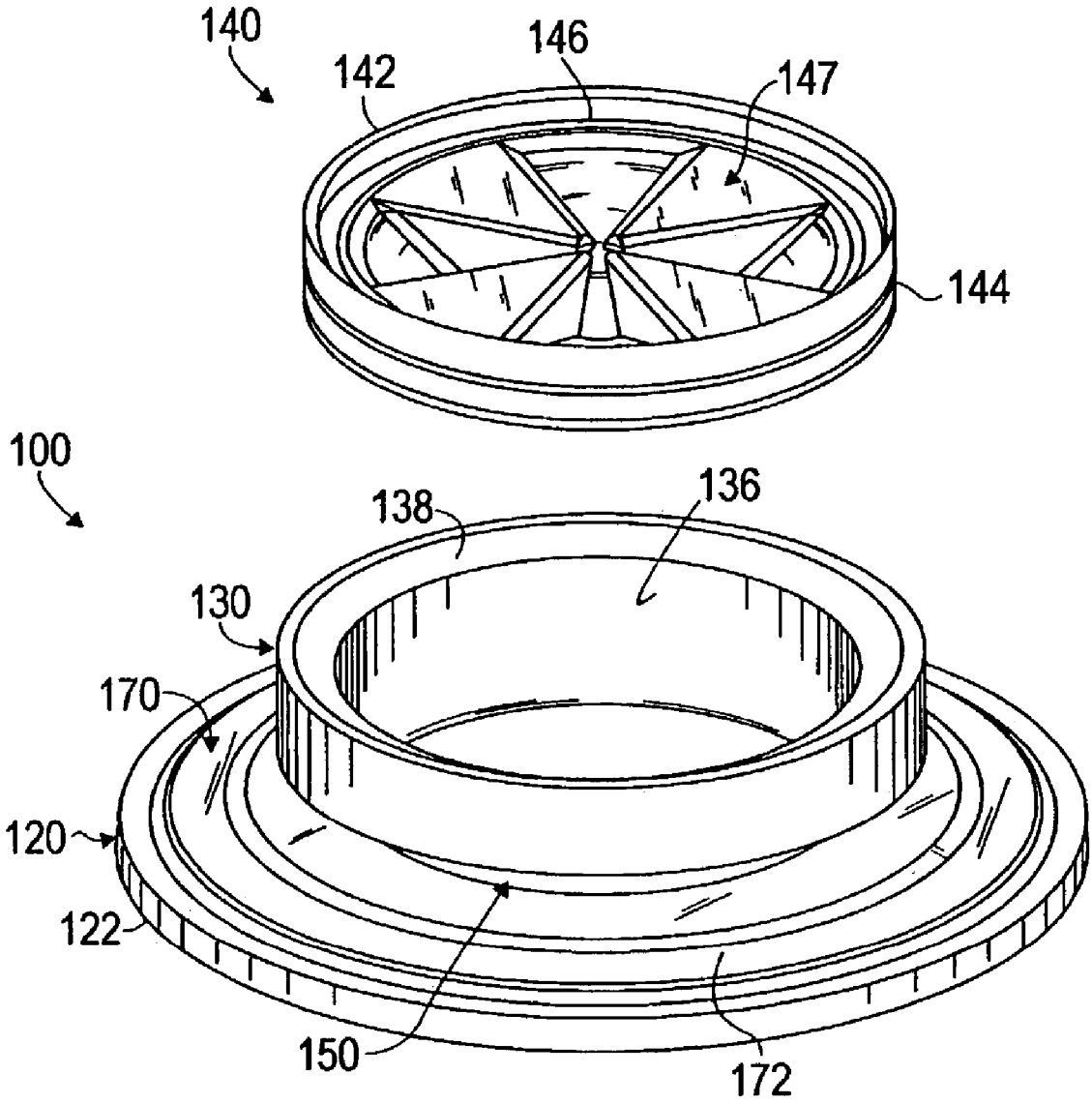
FIG. 7 illustrates a perspective view of another embodiment of a vibration isolation gasket.

FIG. 7 discloses yet another embodiment of a vibration isolation gasket 100, which is illustrated in a perspective view. Those components that are similar in structure and function to the gasket described earlier are similarly numbered and are not repeated here. In contrast to previous embodiments, the gasket portion 130 of the present embodiment, while still molded to the container cover 120, does not include a plurality of pleats formed in the opening 136. Instead, the isolation gasket 100 of FIG. 7 includes a secondary baffle 140 that can be mounted in the drain opening (not shown) above the gasket portion 130. The secondary baffle 140 can be similar to those disclosed in U.S. patent application Ser. No. 10/066,893, filed Feb. 4, 2002 and entitled "Baffle for a Food Waste Disposer to Reduce Noise and Associated Methods," which is incorporated herein by reference in its entirety.

The secondary baffle 140 has an annular body 142, which can have a recessed rim 144 for engaging a complimentary rib formed on the drain opening (not shown). A plurality of pleats 147 are formed in an opening 146 though the secondary baffle 140, which as in earlier embodiments reduces noise transmitted through the opening and prevents food waste from escaping. When the disclosed gasket 100 of FIG. 7 is installed on the drain opening, the bottom of the secondary baffle 140 preferably tightly fits into the drain opening and is positioned to rest on an annular surface or shoulder 138 of the gasket portion 130. So configured, the secondary baffle 140 allows a user to readily clean or replace the secondary baffle 140 if needed without having to remove the mounting gasket and/or otherwise disassemble or disconnect the disposer from under the sink. Because the pleats 147 in the baffle 140 are relatively thin and subject to wear and tear, this embodiment is believed particularly user-friendly.

In contrast to prior art solutions, the disclosed over-molded vibration isolation gasket does not considerably increase the distance between the disposer and the sink, which might otherwise require a number of modifications to the plumbing to be connected to the disposer. Furthermore, the disclosed over-molded vibration isolation gasket minimizes the number of mechanical couplings needed to install the disposer, which reduces the possibility of an improper installation. Moreover, manufacturing of the disposer is simplified because the mounting gasket and container cover are integrated into a single piece. Other benefits are evident to those of ordinary skill in the art.

The foregoing description of preferred and other embodiments is not intended to limit or restrict the scope or applicability of the inventive concepts conceived of by the Applicants or defined in the appended claims. In exchange for disclosing the inventive concepts contained herein, the Applicants desire all patent rights afforded by the appended claims. It is intended that the inventions defined by the appended claims include all modifications and alterations to the full extent that such modifications or alterations come within the scope of the appended claims or the equivalents thereof.

What is claimed is:

1. A food waste mountable to a sink defining a surface having a drain opening therethrough, the food waste disposer comprising:

a housing including a body portion defining a side wall and a top portion connected to the body portion, the top portion defining a plane generally perpendicular to the side wall and generally parallel to a plane defined by the surface of the sink having the drain opening therethrough, the top portion having a central opening therethrough generally coaxial with the drain opening when the housing is mounted to the sink;

a rubberized vibration isolation gasket having a deformable gasket portion connectable to a sink via a sink connecting assembly and defining a central opening with a plurality of pleats extending into the central opening of the gasket portion, an overmolded portion and a sleeve portion connecting the deformable gasket portion and the overmolded portion, wherein the overmolded portion is received in the central opening of the top portion and is at least partially overmolded onto the top portion of the disposer housing such that the deformable gasket portion and the sleeve portion extend above the plane defined by the top portion and the overmolded portion extends below the plane defined by the top portion, and wherein at least a portion of the pleats extend below the plane defined by the top portion.

2. The food waste disposer of claim 1, wherein the top portion of the disposer is crimped to the body portion of the disposer housing.

3. The food waste disposer of claim 1, wherein the top portion of the disposer is metallic.

4. The food waste disposer of claim 1, wherein the sleeve fully supports the disposer housing when mounted to the sink.

5. The food waste disposer of claim 1, wherein the sleeve and the deformable gasket portion are integrally formed.

6. The food waste disposer of claim 1, wherein the sleeve has an outside diameter smaller than an outside diameter of the deformable gasket portion.

7. The food waste disposer of claim 1, wherein the sleeve has a radial thickness thinner than a radial thickness of the deformable gasket portion.

8. The food waste disposer of claim 1, wherein the sleeve is tubular and circumscribes an opening for communicating food to a grinding chamber.

9. The food waste disposer of claim 1, wherein the overmolded portion of the gasket comprises an upper overmold affixed to an upper surface of the top portion and a lower overmold affixed to a lower surface of the top portion.

10. The food waste disposer of claim 9, wherein the top portion of the housing defines at least one hole situated between the central opening and an outer periphery of the top portion through which the upper and lower overmolds touch.

11. The food waste disposer of claim 1, wherein the top portion of the housing contains means for improving the adhesion between the overmolded gasket and the top portion of the housing.

12. The food waste disposer of claim 1, wherein the baffle is further positioned on an upper shoulder of the gasket.

13. The food waste disposer of claim 1, further comprising a first annular flange positioned below a bottom shoulder of the deformable gasket portion, wherein the first annular flange is coupleable to a second annular flange coupled to the sink to connect the disposer underneath the sink.

* * * * *